US006135312A

United States Patent [19]

Chen

[11] Patent Number: 6,135,312

[45] Date of Patent: Oct. 24, 2000

[54] CUP DEVICE

[76] Inventor: Chin Yuan Chen, No. 26, Alley 639, Lane Chien Hsien, Section 3 Chung Shan Road, Wu Jih Shiang, Taichung Hsien, Taiwan

[21] Appl. No.: 09/204,533

[22] Filed: Dec. 3, 1998

[51] Int. Cl.[7] ..... B65D 25/28

[52] U.S. Cl. ..... 220/737; 220/754; 220/758; 220/769

[58] Field of Search ..... 220/758, 696, 220/710.5, 737, 769

[56] References Cited

U.S. PATENT DOCUMENTS

| | | | |
|---|---|---|---|
| 77,215 | 4/1868 | Reistle | 220/710.5 |
| 692,802 | 2/1902 | Strope | 220/710.5 |
| 904,237 | 11/1908 | Thessen | 220/758 |
| 1,550,618 | 8/1925 | Kemp | 220/710.5 |
| 1,681,197 | 8/1928 | Rueff | 220/710.5 |
| 2,215,402 | 9/1940 | McDonald | 220/758 |
| 2,617,676 | 11/1952 | Kinney, Jr. | 220/758 |
| 2,673,115 | 3/1954 | Vrana | 220/710.5 |
| 2,677,947 | 5/1954 | Van Guilder | 220/710.5 |
| 3,682,352 | 8/1972 | Doucette | 220/758 |
| 4,685,583 | 8/1987 | Noon | 220/710.5 |
| 5,002,193 | 3/1991 | Touzani | 220/758 |
| 5,968,618 | 10/1999 | Miller | 220/758 |

FOREIGN PATENT DOCUMENTS

| | | | |
|---|---|---|---|
| 1130355 | 2/1957 | France | 220/758 |

*Primary Examiner*—Joseph M. Moy
*Attorney, Agent, or Firm*—Charles E. Baxley

[57] ABSTRACT

A cup device includes a cup member having a peripheral shoulder formed in the outer peripheral portion for forming a smaller lower portion and a greater upper portion. A holder device includes a ring engaged with the smaller lower portion of the cup member and engaged with the peripheral shoulder of the cup member and includes a hand grip for holding the cup member in place. The cup member includes an open top formed by a peripheral rim. The holder device includes another ring engaged with the peripheral rim of the cup member. The peripheral rim of the cup member and the rings of the holder device are inclined relative to the base of the cup member.

8 Claims, 3 Drawing Sheets

CUP DEVICE

BACKGROUND OF THE INVENTION

1. Field of the Invention

The present invention relates to a holder, and more particularly to a cup holder device.

2. Description of the Prior Art

Typical cups of paper or plastic materials may not be held by the user when containing hot water or hot drink therein.

The present invention has arisen to mitigate and/or obviate the afore-described disadvantages of the conventional cups.

SUMMARY OF THE INVENTION

The primary objective of the present invention is to provide a cup device which may be used as a cup itself and which may be used for holding the plastic cups or paper cups.

In accordance with one aspect of the invention, there is provided a cup device comprising a cup body including a peripheral portion and including a middle portion having a peripheral shoulder formed therein for forming a lower portion of a smaller size and an upper portion of a greater size, and a holder device including a first ring engaged with the smaller lower portion of the cup body and engaged with the peripheral shoulder of the cup body, and including a hand grip for holding the cup body in place.

The cup body includes a horizontal base, and the peripheral shoulder of the cup body and the first ring of the holder device are inclined relative to the base of the cup body.

The cup body includes an open top defined by a peripheral rim, the holder device further includes a second ring engaged with the peripheral rim of the cup body.

The peripheral rim of the cup body and the second ring of the holder device are inclined relative to the base of the cup body.

The peripheral rim of the cup body includes a radially inward portion having a peripheral recess formed therein, the second ring of the holder device includes an annular flange extended downward therefrom for engaging with the peripheral recess of the cup body.

The holder device includes a coupling member provided between the first and the second rings for forming the hand grip.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
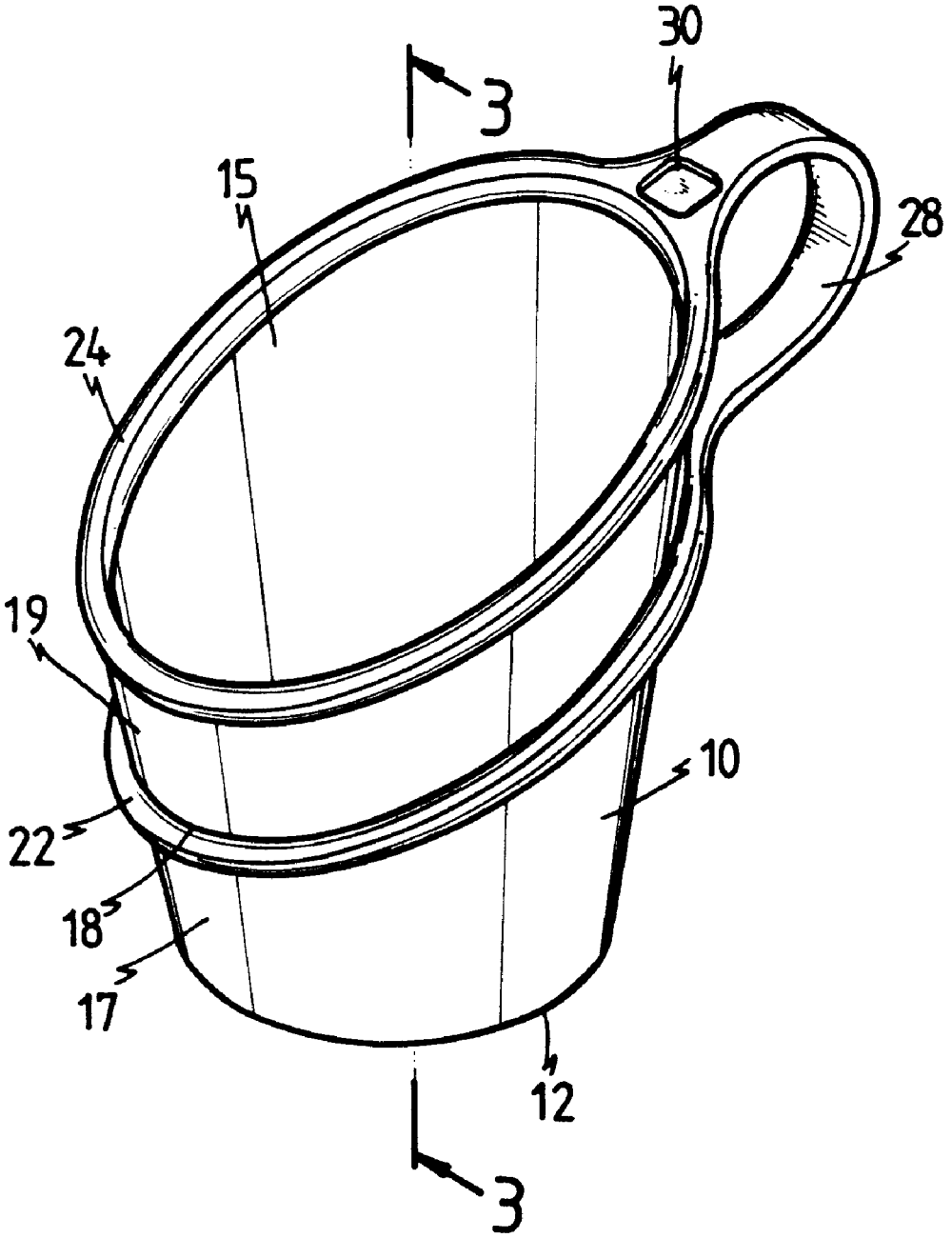
FIG. 1 is a perspective view of a cup device in accordance with the present invention.
Figure 2:
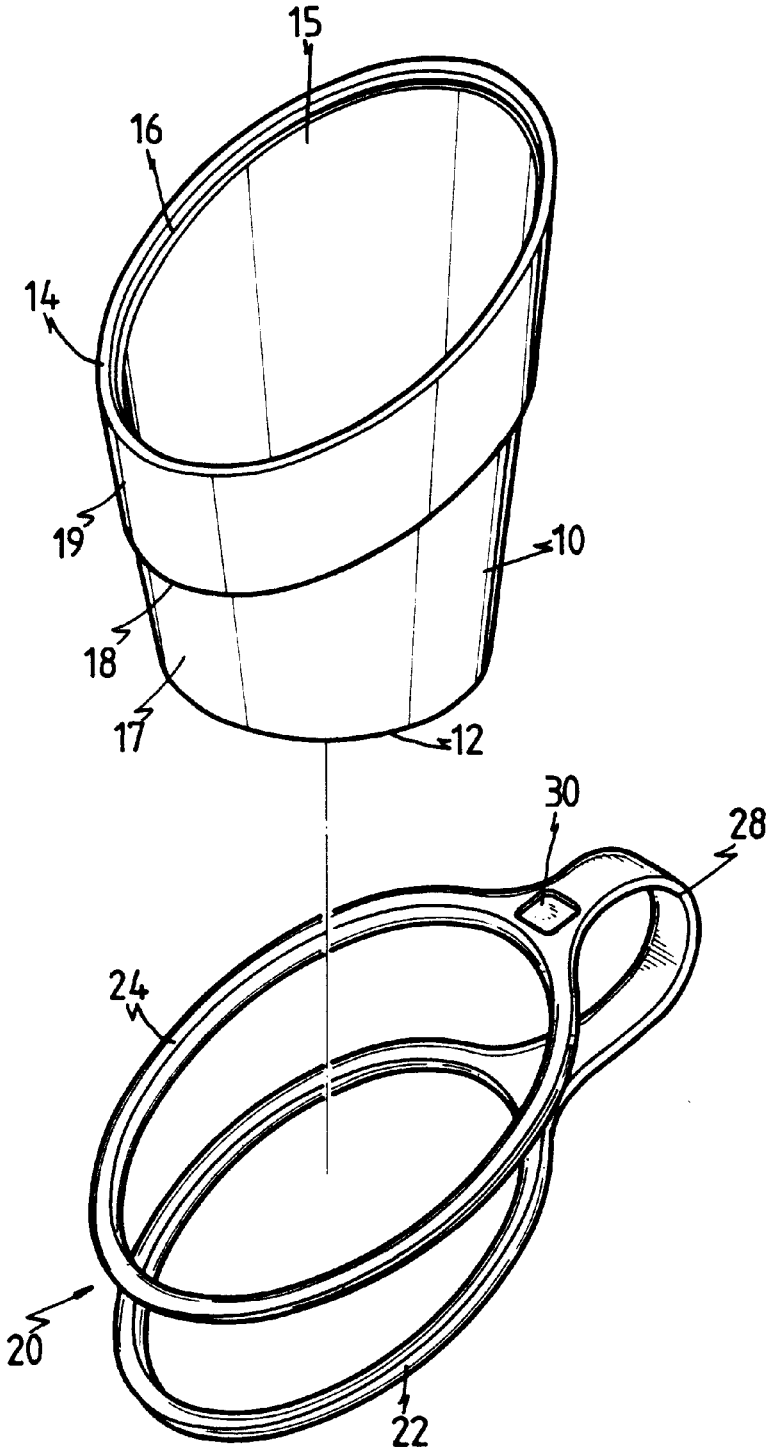
FIG. 2 is an exploded view of the cup device.

Referring to the drawings, a cup device in accordance with the present invention comprises a cup body 10 including a substantially frustum-shape and including a horizontal base 12 and an open top 15 defined by an inclined upper peripheral rim 14 and including a peripheral recess 16 formed in the radially inner portion of the upper peripheral rim 14 of the cup body 10. The cup body 10 includes an outer peripheral portion having an inclined peripheral shoulder 18 formed in the middle portion thereof and preferably parallel to the upper peripheral rim 14 of the cup body 10 for forming a lower portion 17 of the cup body 10 having a size smaller than that of the upper portion 19 of the cup body 10.

A holder device 20 includes a first ring 22 having a size for engaging with the smaller lower portion 17 of the cup body 10 and for engaging with the inclined peripheral shoulder 18 of the cup body 10 such that the cup body 10 may be held by the holder device 20. The holder device 20 further includes a second ring 24 having an annular flange 26 extended downward therefrom for engaging with the peripheral recess 16 of the cup body 10 and for securing to the cup body 10 by such as a force-fitted engagement. The cup body 10 and the holder device 20 are preferably made of plastic materials such that the second ring 24 of the holder device 20 may be secured to the cup body 10 by such as a welding process, particularly a ultrasonic welding process, for further solidly securing the holder device 20 to the cup body 10. The holder device 20 includes a coupling member 28 provided between the rings 22, 24 and folded to form a hand grip 28 when the rings 22, 24 are arranged parallel to each other. The holder device 20 may include one or more depressions 30 formed therein for attaching a tag or for applying with a pattern or trademark.

Figure 3:
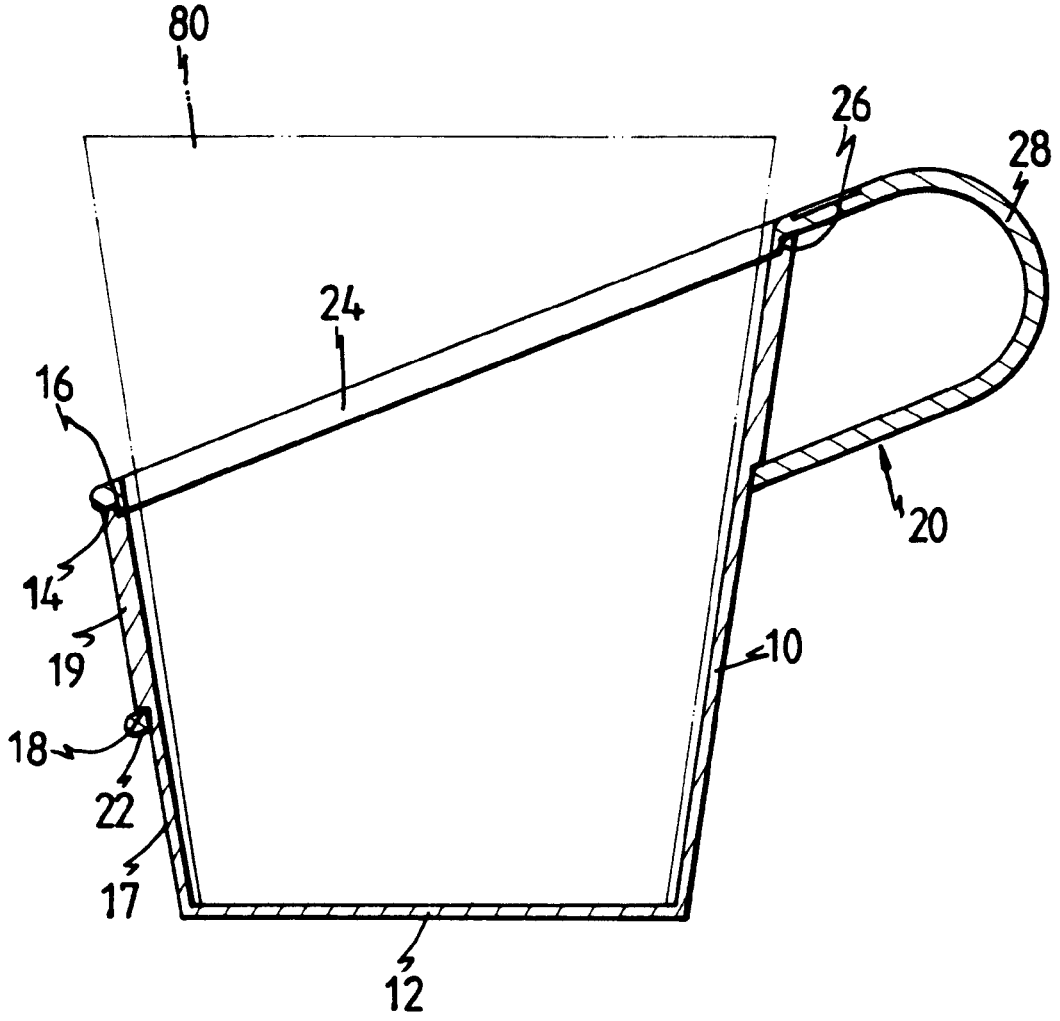
FIG. 3 is a cross sectional view taken along lines 3—3 of FIG. 1.

In operation, the cup body 10 of the cup device itself may be used as a cup for receiving water or drink. As shown in FIG. 3, the cup device may also be used for receiving the typical paper or plastic cups 80, particularly when the cup 80 receives hot water or hot drink. The provision of the inclined peripheral rim 14 of the cup body 10 increases the size of the open top 15 of the cup body 10 for allowing the cup device to hold the cups 80 of greater sizes.

It is to be noted that the cup body 10 may also be formed without the base 12 and may be formed with a peripheral wall of a suitable slop for holding the cups 80 of various sizes. The peripheral shoulder 18 of the cup body 10 and the first ring 22 of the holder device 20 may also be made parallel to the base 12 without any inclination.

Accordingly, the cup device in accordance with the present invention may be used as a cup itself and may be used for holding the plastic cups or paper cups.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A cup device comprising:

a cup body including a horizontal base and including a peripheral portion having a middle portion including a peripheral shoulder formed therein, thereby defining a lower portion of a smaller size and an upper portion of a greater size, said peripheral shoulder inclined relative to said horizontal base of said cup body, and a holder device including a first ring mounted on said lower portion of said cup body and securely engaged with said peripheral shoulder of said cup body, and including a hand grip extending from said first ring for holding said cup body in place, said first ring of said holder inclined relative to said horizontal base of said cup body.

2. The cup device as claimed in claim 1, wherein said cup body includes an open top defined by a peripheral rim, said holder device further includes a second ring engaged with said peripheral rim of said cup body.

3. The cup device as claimed in claim 2, wherein said peripheral rim of said cup body and said second ring of said holder device are inclined relative to said base of said cup body.

4. The cup device as claimed in claim 2, wherein said peripheral rim of said cup body includes a radially inward portion having a peripheral recess formed therein, said second ring of said holder device includes an annular flange extended downward therefrom for engaging with said peripheral recess of said cup body.

5. The cup device as claimed in claim 2, wherein said holder device includes a coupling member provided between said first and said second rings for forming said hand grip.

6. A cup device comprising:

a cup body including an outer periphery having an upper portion defining an open top and a lower portion having a size smaller than that of said upper portion, an annular shoulder formed between said upper portion and said lower portion, said upper portion including a peripheral rim defining an annular recess therein; and a holder including a first ring mounted on said lower portion of said cup body and securely engaged with said annular shoulder of said cup body, a second ring mounted on said peripheral rim of said upper portion of said cup body and having an annular flange extending downward therefrom and securely received in said peripheral recess of said peripheral rim of said upper portion of said cup body, and a handgrip mounted between said first ring and said second ring.

7. A cup device as claimed in claim 6, wherein said cup body includes a horizontal base, and said annular shoulder of said cup body and said first ring of said holder are each inclined relative to said horizontal base of said cup body.

8. A cup device as claimed in claim 7, wherein said peripheral rim of said cup body and said second ring of said holder are each inclined relative to said horizontal base of said cup body.

* * * * *